US006993942B2

(12) United States Patent
Boni et al.

(10) Patent No.: US 6,993,942 B2
(45) Date of Patent: Feb. 7, 2006

(54) ADJUSTABLE LOCKING STRAP APPARATUS

(76) Inventors: Christopher Boni, 56 Amherst Pl., Livingston, NJ (US) 07039; Mark Anders, 1440 Westminister St., Apt. 3, Providence, RI (US) 02909

( * ) Notice: Subject to any disclaimer, the term of this patent is extended or adjusted under 35 U.S.C. 154(b) by 0 days.

(21) Appl. No.: 10/295,020

(22) Filed: Nov. 14, 2002

(65) Prior Publication Data

US 2003/0089142 A1 May 15, 2003

Related U.S. Application Data

(63) Continuation-in-part of application No. 10/002,941, filed on Nov. 15, 2001.

(51) Int. Cl.
*E05B 73/00* (2006.01)

(52) U.S. Cl. ..... 70/18; 70/14; 70/57

(58) Field of Classification Search ..... 70/14, 70/18, 57, 58; 224/315, 324, 309
See application file for complete search history.

(56) References Cited

U.S. PATENT DOCUMENTS 4,340,376 A * 7/1982 Williams ..... 441/74
4,366,605 A * 1/1983 McKenney ..... 70/58
4,402,442 A * 9/1983 Martino ..... 224/324
4,526,125 A 7/1985 Bain, Jr. ..... 114/347
4,527,827 A * 7/1985 Maniscalco et al. ..... 224/405
4,630,990 A * 12/1986 Whiting ..... 414/462
4,724,989 A * 2/1988 Silberberg ..... 224/609
4,765,521 A * 8/1988 Finnegan ..... 224/315
4,795,178 A * 1/1989 Nabarrete ..... 280/47.331
4,896,519 A 1/1990 Pitts ..... 70/58
4,957,400 A * 9/1990 Karp ..... 410/110
5,052,605 A * 10/1991 Johansson ..... 224/324
5,067,644 A * 11/1991 Coleman ..... 224/324
5,088,158 A * 2/1992 Burkholder ..... 24/16 PB
5,095,722 A 3/1992 Chapmond et al. ..... 70/18
5,115,955 A * 5/1992 Dallaire et al. ..... 224/324
5,118,018 A * 6/1992 Baldeck ..... 224/493
5,146,874 A 9/1992 Vidal ..... 119/95
5,159,728 A * 11/1992 Bingold ..... 24/16 PB
5,263,592 A 11/1993 Dingee, Jr. ..... 211/64

(Continued)

FOREIGN PATENT DOCUMENTS

DE 3103783 A1 9/1982

*Primary Examiner*—John B. Walsh
(74) *Attorney, Agent, or Firm*—McCarter & English, LLP

(57) ABSTRACT

An adjustable locking strap apparatus for locking an elongate object includes a first loop, a second loop, and an adjustable strap extending therebetween. The loops can be fit about ends of the elongate object. One loop could be adjusted adjusted for proper size. The strap extending between the loops can be adjusted between the loops so that when the first and second loops are positioned about the elongate object, the strap is sized to prevent either loop from being removed from the object. A lock is interconnected with the adjustable loop and strap for securing the size of the adjustable loop and strap. A tether portion can secure the locking strap to a fixed object. A stopper on the tether can be positioned within a car, and the window rolled up to retain the locking strap within a car. In other embodiments, two straps with loops at one end and stoppers at the other end can used. One loop is positioned about an end of the elongate object and the strap is retained in a housing. The other loop connects with the housing, the strap loops over the object and is retained in the housing. The stoppers may be inserted within a vehicle.

40 Claims, 6 Drawing Sheets

U.S. PATENT DOCUMENTS 5,582,044 A * 12/1996 Bolich ..... 70/58
5,695,101 A * 12/1997 Frietze ..... 224/250
5,706,680 A 1/1998 Wroble ..... 70/18
5,738,258 A * 4/1998 Farrow et al. ..... 224/324
5,769,291 A * 6/1998 Chasan ..... 224/324
5,802,675 A * 9/1998 Parsons ..... 24/16 R
5,802,888 A * 9/1998 Parsons ..... 70/16
5,832,754 A * 11/1998 McKenzie ..... 70/58
5,873,505 A 2/1999 Sovitski ..... 224/576
5,956,979 A 9/1999 Collins et al. ..... 70/18
6,003,348 A 12/1999 McCrea ..... 70/18
6,006,555 A 12/1999 Shu-Fen ..... 70/18
6,082,154 A 7/2000 MacDonald ..... 70/18
6,101,682 A * 8/2000 Parsons ..... 24/16 PB
6,151,761 A * 11/2000 Thompson ..... 24/16 PB
6,219,887 B1 * 4/2001 Parsons ..... 24/16 PB
6,263,709 B1 7/2001 Kemery et al. ..... 70/14
6,374,645 B1 4/2002 Fontes et al. ..... 70/18
6,457,619 B1 * 10/2002 Werner et al. ..... 224/405
6,539,589 B2 * 4/2003 Thompson ..... 24/16 PB
6,561,398 B1 * 5/2003 Cole et al. ..... 224/324
6,616,107 B1 * 9/2003 Hargreaves ..... 248/68.1
2001/0031588 A1 * 10/2001 Young ..... 441/74

* cited by examiner

ADJUSTABLE LOCKING STRAP APPARATUS

RELATED APPLICATIONS

This application is a continuation-in-part application of U.S. patent application Ser. No. 10/002,941, filed Nov. 15, 2002 by Christopher Boni, entitled Adjustable Locking Strap, the entire disclosure of which is expressly incorporated herein by reference.

BACKGROUND OF THE INVENTION

1. Field of the Invention

The present invention relates to an adjustable locking strap apparatus for attachment to elongate objects such as a surfboards or the like to protect against the theft thereof.

2. Related Art

Various locking devices have been developed in the past for locking personal belongings to guard against theft. Among the most well-known type of such a lock is a bicycle lock which includes a chain or cable having fixed loops at each end. The cable can be extended through the bicycle frame, about a fixed object such as a fence or pole and then the ends can be secured together by means of a lock such as a combination lock or key lock. However, such locks are insufficient to protect items lacking a space therein for inserting a cable therethrough. A surfboard is such an object that does not have any space or opening to thread a cable through.

Past efforts to provide locks for surfboards and the like include attempts to provide adjustable loops for fitting about a surfboard wherein the loop is specifically sized to be secured between the fins and the wider area of the board. However, this is a very inflexible approach and does not allow one to use the lock interchangeably with different size surfboards. Another approach is to provide a device with a plurality of locks, one lock for interconnecting two loops together about an elongate object and another lock for securing a loop through one of the two loops and about a stationary body. However, this is a cumbersome approach. Other efforts include attaching hardware to a surfboard to allow for a lock to be attached to the surfboard. However, such an approach could cause damage to the surfboard. Other efforts disclose one or two adjustable loops, but do not allow for the locked object to be connected to a fixed object such as a car.

Accordingly, what is needed, but has not heretofore been provided, is an easily adjustable device for locking surfboards and the like which does not damage the object being locked, and which allows for the object to be secured to a fixed object.

OBJECTS AND SUMMARY OF THE INVENTION

It is an object of the present invention to provide an easily adjustable device for locking surfboards and other elongate objects.

It is another object of the present invention to provide a lock for elongate objects that have no space for receiving a conventional cable lock.

It is a further object of the present invention to provide an adjustable locking strap for surfboards and the like which is easily adjustable for locking objects of various sizes.

These and other objects of the present invention are achieved by an adjustable locking strap apparatus which includes a first loop, a second loop, and an adjustable strap extending therebetween. The first loop can be fit about a first end of the elongate object, and the second loop can be positioned about a second end of the elongate object. The second loop may be adjustable for proper size. The strap extending between the loops can similarly be adjusted between the loops so that when the first and second loops are positioned about the elongate object, the strap is sized to prevent either loop from being removed from the object. A lock is interconnected with one of the loops and the strap for securing the size of the adjustable strap. A tether portion can secure the locking strap to a fixed object. A stopper on the tether can be positioned within a car, and the window rolled up to retain the locking strap within a car. A storage bag can be interconnected with the strap for convenient storage thereof.

The present invention also provides an adjustable locking strap apparatus which includes a housing provided at a location along the elongate object. The apparatus also includes two straps, each with a loop at one end and a stopper at the other end. One loop is positioned about a first end of the object and the strap is interconnected with the housing. The other loop is interconnected with the housing and the strap is looped about the object and is then interconnected with the housing. The housing has retaining slots for the straps to pass through. The slots are sized to frictionally engage the straps, and may include teeth or ridges to enhance such engagement. The straps are pulled through the retaining slots of the housing and are retained so as to prevent the straps from being moved in a manner that would allow the loops to be removed from the ends of the object. The stoppers at the end of the straps can be positioned within a door or window of a vehicle to lock the elongate object thereto. The housing can include a cover. The cover could have fingers that coact with the slots to prevent the straps from disengaging from the slots. The housing cover could have a lock. The housing could be supported by a channel that engages the elongate object or which is positioned between the elongate object and the roof of a vehicle during use.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The present invention relates to an adjustable locking strap apparatus for use in locking elongate objects, such as surfboards and the like, to prevent the theft thereof. The adjustable locking strap apparatus includes first and second loops interconnected by an adjustable strap. One of the loops may be adjustable. The loops extend about ends of the elongate object. The loops are connected together by the adjustable strap which is sized such that the loops cannot be removed from the elongate objects. A tether is provided to lock the locking strap and the elongated object to a fixed object.

In another embodiment, the adjustable locking strap apparatus includes two straps, each of which has a loop at one end and a stopper at the other end. A housing is provided at a location along the elongate object, the housing having retaining slots for the straps to pass through. The slots are sized to frictionally engage the straps, and may include teeth or ridges to enhance such engagement. One loop is positioned over one end of the object and the strap is engaged with the housing. The other loop is connected to the housing and the strap is looped over the object and back to the housing where it is engaged. The straps are pulled through the retaining slots of the housing and are thereby retained so as to prevent the straps from being moved in a manner that would allow the loops to be removed from the ends of the object. The stoppers at the end of the straps can be positioned within a door or window of a vehicle to lock the elongate object thereto.

Figure 1:
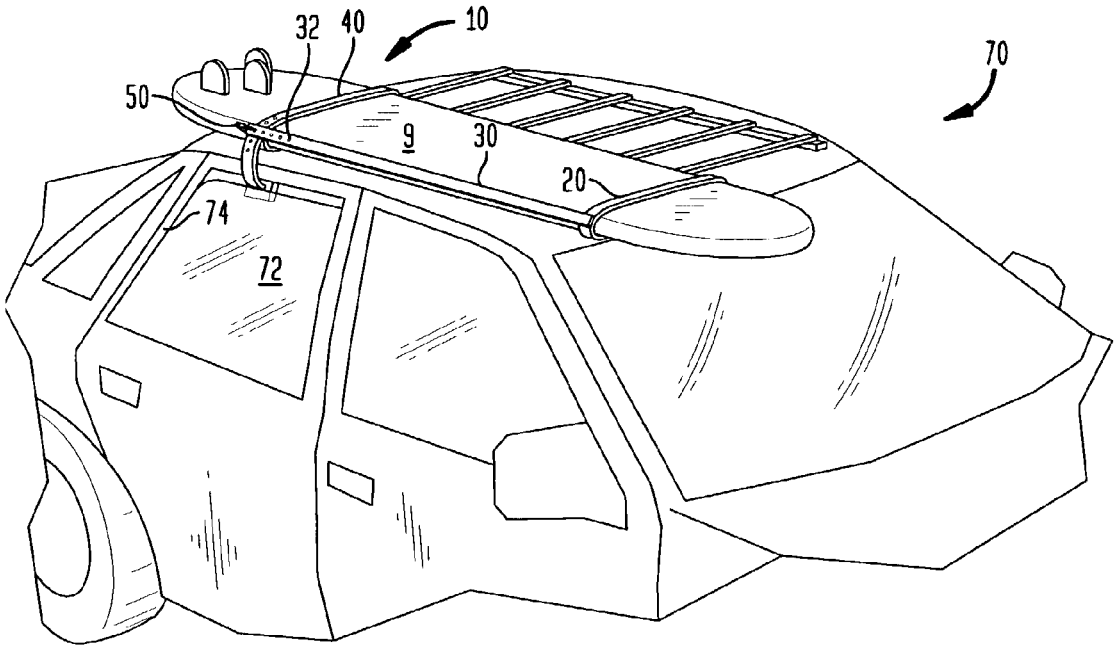
FIG. 1 is a perspective view of the adjustable locking strap apparatus of the present invention positioned about a surfboard on a car and locked thereto.
Figure 2:
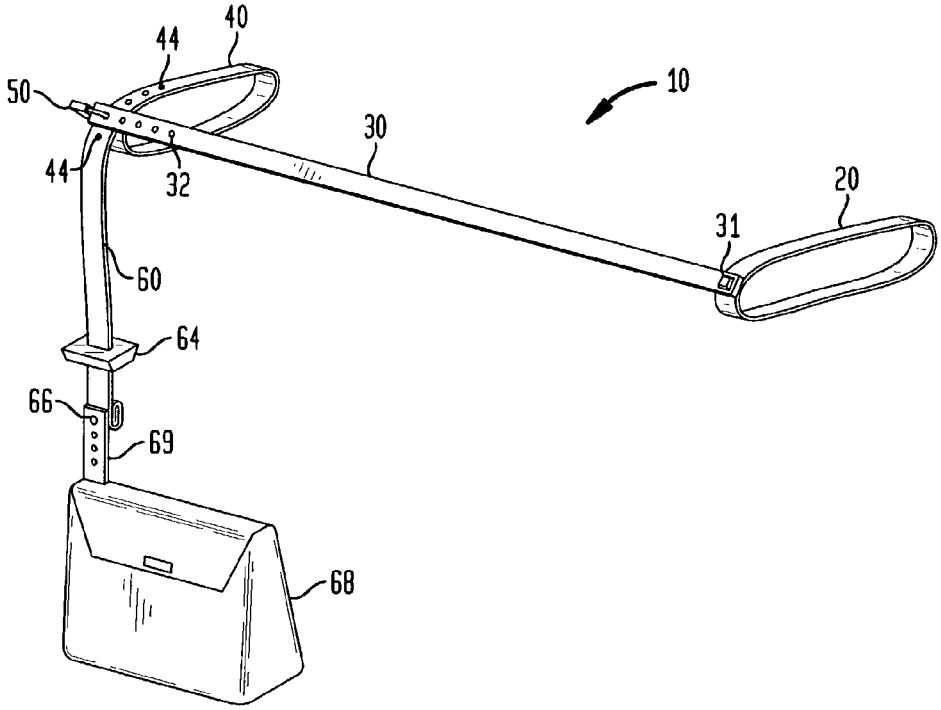
FIG. 2 is a perspective view of the locking strap shown in FIG. 1.
Figure 3:
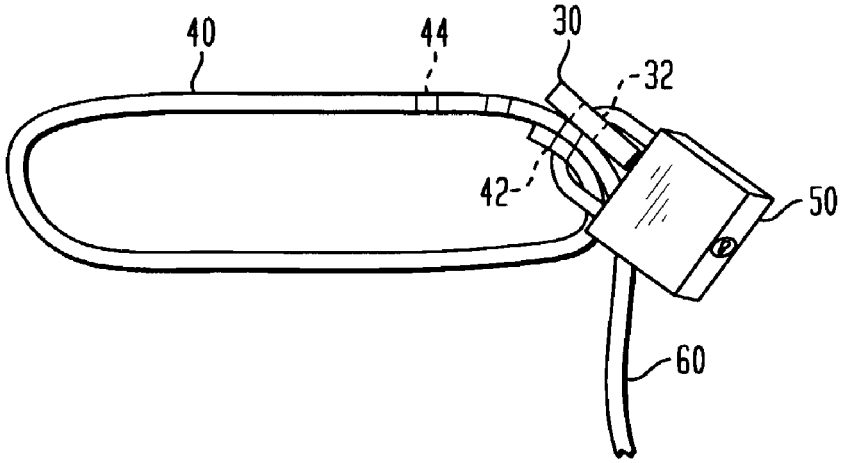
FIG. 3 is a partial side view of the strap shown in FIG. 1.

As shown in FIGS. 1–3, the adjustable locking strap of the present invention, generally indicated at 10, includes a first loop 20 which can be a fixed size or can be adjustable in size. Loop 20 can be positioned about one end of an elongated object such as surfboard 9, and is sized to fit about an end of the object but is not large enough to slide over the central portion of the object. A first end of a strap 30 is interconnected with the loop 20 in any means known in the art, for example, by stitching 31 for securing the strap 30 to loop 20. The strap 30 may include a plurality of apertures 32 along the second end thereof.

A second loop generally indicated at 40 is attachable to the second end of strap 30. The second loop may be adjustable in size and may include an aperture 42 at a first end and a plurality of apertures 44 along the second end thereof. Aperture 42 can be aligned with one of apertures 44, and both can be aligned with one of the apertures 32 of strap 30. Lock 50 can be extended through the apertures 42, 44 and 32 to form the loop 40 of a desired size and to position it at a desired position along the length of strap 30 so that both loops are positioned about surfboard 9.

The excess length of loop 40 forms a tether 60 which can be used to lock the adjustable locking strap 10 to a stationary object. The tether 60 could also be formed of an excess length of strap 30 or could be a separate member attachable to the strap or loop or both. Stopper 64 can be interconnected with the end of tether strap 60. Alternatively, or additionally, a plurality of apertures can be provided along the tether strap 60 to permit the tether to be looped back on itself and locked by lock 50 to form a loop for extending about a fixed object for locking the lock and the elongate object thereto.

Figure 4:
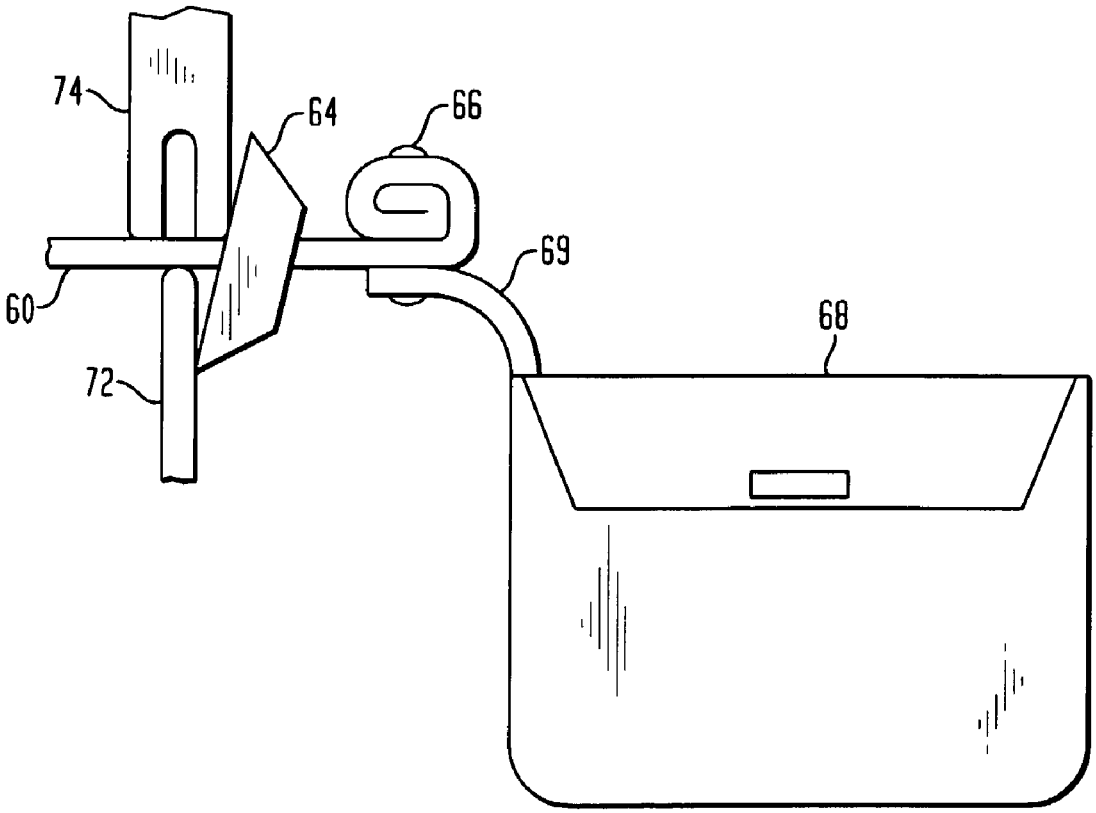
FIG. 4 is a partial side view of the locking strap shown in FIG. 1 with the stopper device positioned within a car.
Figure 5:
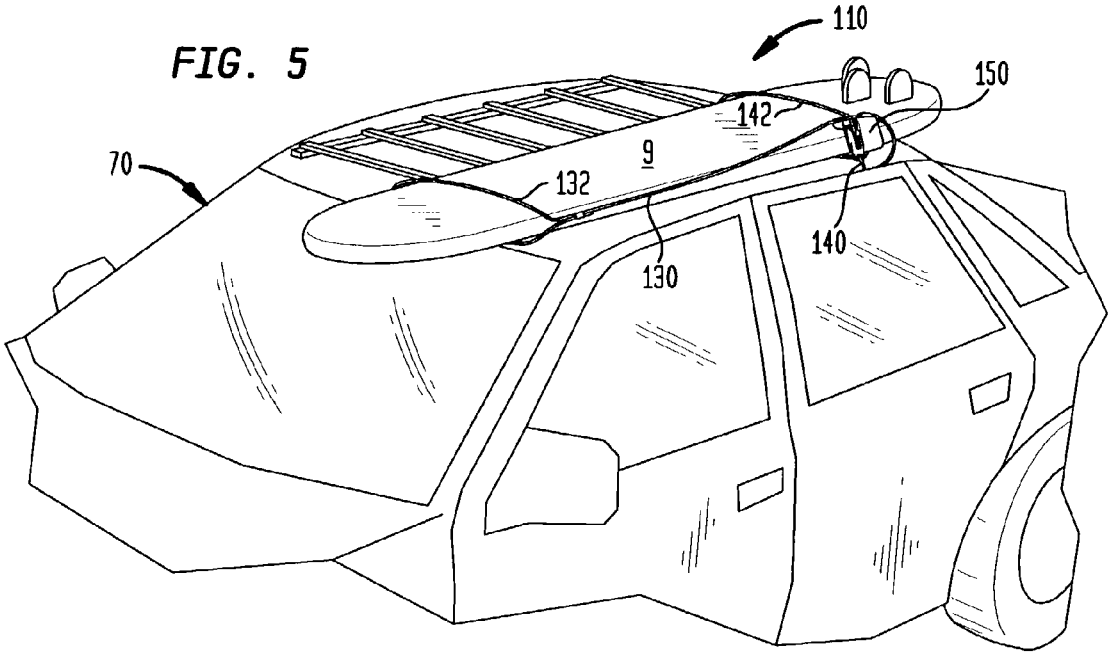
FIG. 5 is a perspective view of another embodiment of the adjustable locking strap apparatus of the present invention positioned about a surfboard on a car and locked thereto.
Figure 6:
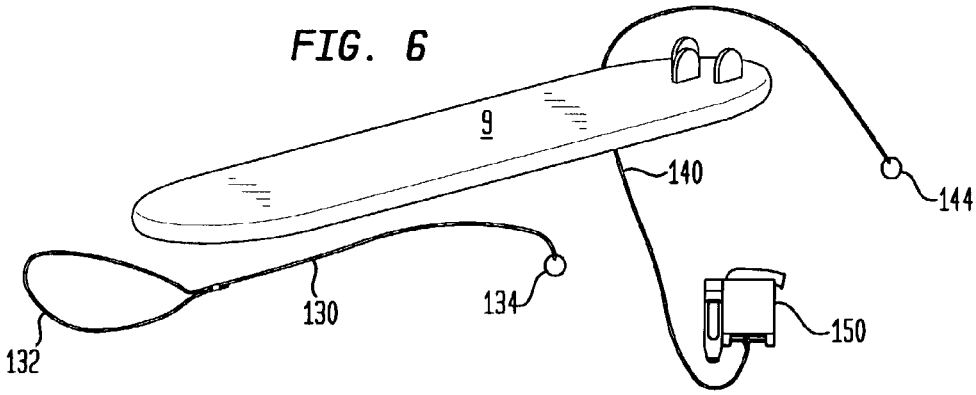
FIG. 6 is an exploded view of the apparatus shown in FIG. 5.

As shown in detail in FIG. 4, tether strap 60 can be positioned to extend within a vehicle 70 as defined by window 72 and frame 74. When the window 72 is closed the stopper 64 is retained within the vehicle 70 to effectively lock the locking strap 10 and the elongate object to the vehicle 70. The stopper 64 can be retained on the tether 60 by means of a rivet 66. Further, a storage bag 68 can be interconnected by strap 69 to the rivet 66 and to the tether 60. The storage bag can 68 be used for storing the adjustable locking strap 10 when not in use.

The adjustable locking strap invention provides a simple affordable and effective device for locking a surfboard. The straps used in the adjustable locking strap invention can be made from reinforced nylon, or similar material, or other material known in the art. The loops 20 and 40 can be fixed in size to pass over the end of a surfboard, but not past the widest part of the board. Alternatively, one or both of the loops 20 and 40 can be adjustable. The strap 30 can be interconnected with loop 20 in any way known in the art. One preferred way would be by heavy duty permanent stitching. Generally, the strap 30 will extend for about 36 to 60 inches to the second loop 40, though this distance can vary depending on the size of the elongate object being locked. The strap 30 can be interconnected with second loop 40 at a desired point by means of heavy duty commercial stitching. Alternatively, the interconnection of the strap 30 and loop 40 can be adjustable along the length of strap 30 by interconnecting loop 40 with one of apertures 32 along strap 30 at a desired position as shown in the Figures. Lock 50 can be a standard padlock or combination lock. The window stopper can be affixed on the tether strap 60 or can include an aperture and ride on tether 60. Preferably, the stopper is made of rubber or other non-malleable material as is known in the art. The pouch 68 can be formed of nylon or any other desired material and can use a zipper means or hook and pile type fastening means for closure thereof if desired. Importantly, the tether strap 60 could be part of loop 40, strap 30 or could be a separate element connectable to strap 30 and loop 40 by means of lock 50 passing through an aperture thereof.

In another embodiment of the invention, a single loop can be positioned about between the fins and wide central portion of the board. The size of the loop can be fixed by a lock. A tether strap connected to the loop can be secured about a fixed object to lock the elongate object. A stopper can be interconnected with the tether and positioned within a car window so that when the window is raised, the stopper cannot be removed, and the elongate object is locked to a car.

Another embodiment of the present invention is shown in FIGS. 5–7B. As can be seen, an elongate object such as a surfboard 9 can be locked to an object such as vehicle 70. The adjustable locking strap apparatus, generally indicated at 110, includes first and second straps 130 and 140. Each of first and second straps 130 and 140 has a loop 132 and 142, respectively, formed at one end, and a stopper 134 and 144, respectively, attached to the other end. The straps and loops can be made of the same material, such as wire in a plastic sheath (commonly used for bicycle locks and the like). Not only is such a material strong and sturdy, the plastic sheath is compressible, allowing the strap to be engaged in a retaining slot as will hereinafter be described in greater detail. The loop can be formed by bending the strap back on itself and using a band to pinch the two portions of the strap together.

A housing 150 is provided at a location along the elongate object. One loop is positioned about one end of the object and the strap is engaged to the housing. The other loop is interconnected directly with the housing and the strap is looped over the object and back to the housing. This allows for the size of the second loop to be adjustable to fit central of fins on a surfboard. The housing has retainers such as retaining slots 152 and 154 for the straps 130 and 140 to pass through. Any other type of retaining system used for ropes, wires, cords, etc. could be used. The size and shape of the housing can be varied as desired. The slots 152 and 154 include upstanding walls that are sized to frictionally engage the straps 130 and 140. The slots 152 and 154 could be oriented as desired, but are preferably at right angles to allow for one strap to conveniently enter from the side and for the other strap to enter from the top. Because the housing 150 is placed toward one end of the elongate object, one strap extends from a loop positioned at the far end of the object, while the other loop of the other strap is attached to the housing and the strap extends about the object at or near the housing. Thus, the desirability for orienting the slots at right angles can be appreciated. The slots 152 and 154 can include teeth or ridges to enhance the frictional fit with the straps. Further, the slots 152 and 154 could include top members 156 that effectively form apertures at the ends of the slots to retain the straps therein. An upper leg 162 could be provided at an upper rear surface of the housing 150 for assisting in locating the housing 150 on the elongate object, and for protecting the surface of the object.

Figure 7A:
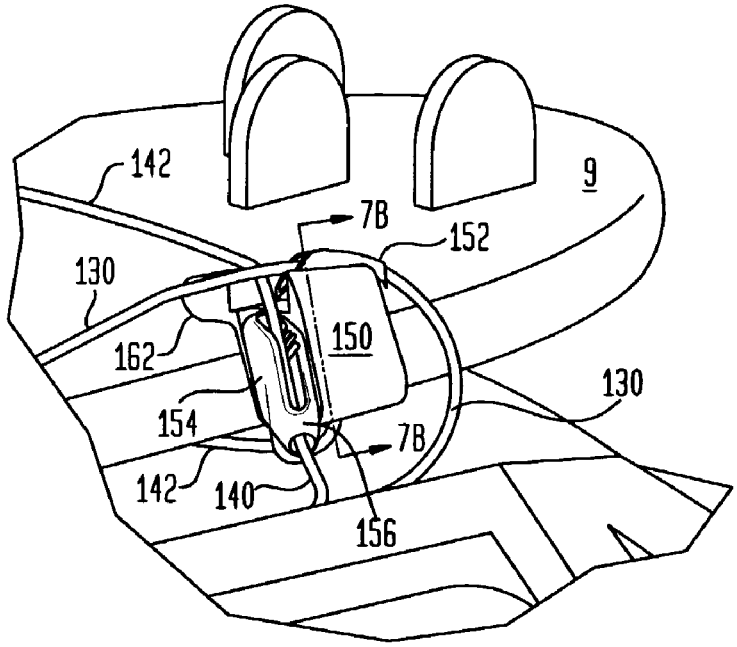
FIG. 7A is a partial perspective view of the housing of the apparatus shown in FIG. 5.
Figure 7B:
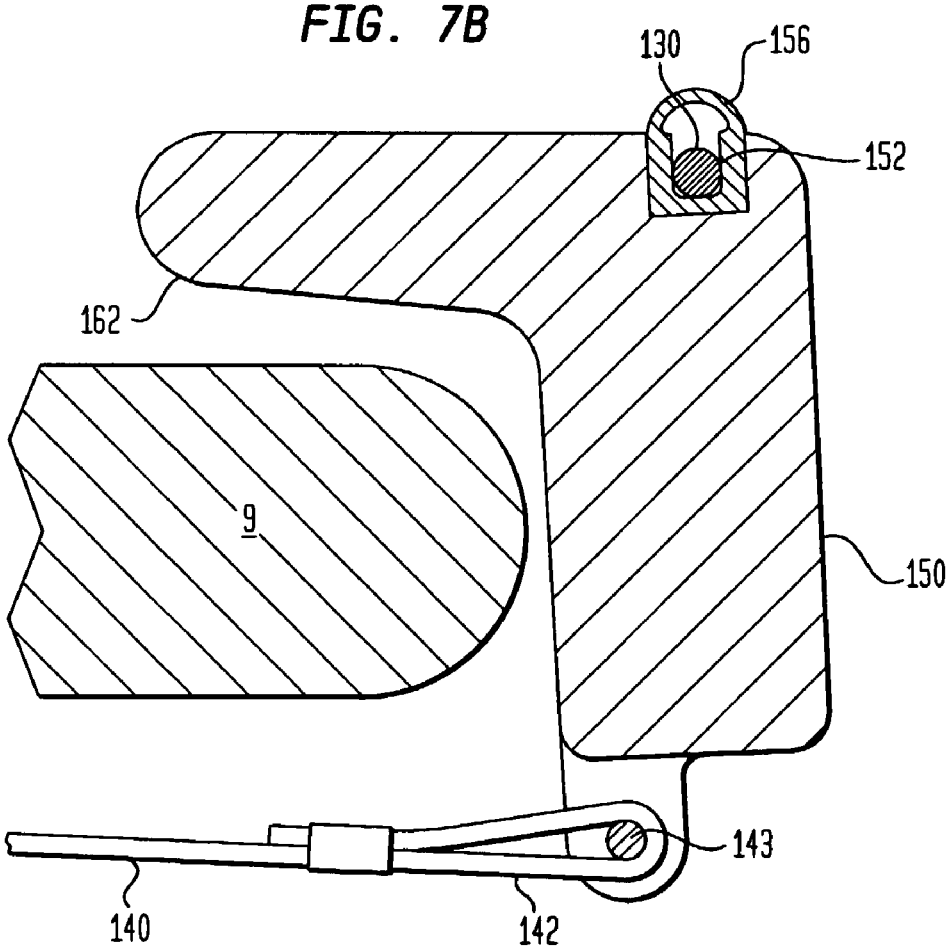
FIG. 7B is a cross-sectional view thereof taken along line 7B—7B.

FIG. 7B is a cross sectional view of the housing shown in FIG. 7A. The housing 150 includes an upper slot 152 having a top wall 156 over a portion thereof to form an aperture at an end of the slot. The housing 150 also includes an upper leg 162 for locating the housing with respect to an elongate object 9. This view shows strap 140 has a loop 142 which extends about pin 143 interconnected with housing 150. Strap 140 could otherwise be attached to housing 150 without the requirement of a loop. Strap 140 can be looped around the elongate object and pulled through a slot in the housing to adjust the length of the strap encircling the elongate object to provide a secure fit.

Once positioned in the slots 152 and 154, the straps 130 and 140 are retained in place, and resist sliding or other movement with respect to the housing 150. After the loops/straps are positioned about the elongate object, the straps are pulled through the retaining slots 152 and 154 and are retained thereby, so as to prevent the straps 132 and 142 from being moved in a manner that would allow the loops/straps to be removed from the ends of the object. Notably, the slots 152 and 154 could be designed to allow the straps 130 and 140 to be pulled through but not back, or alternatively, the straps could be disengaged from the slot, pulled to remove slack and then pressed into the slots. Where the slot has a top member 156, the strap could be pulled through the aperture formed thereby and then pressed into the slot. The stoppers 134 and 144 at the ends of the straps 130 and 140 can be positioned within a door or window of a vehicle to lock the elongate object thereto. Importantly, only one stopper needs to be engaged with the vehicle as only one is necessary to lock the apparatus. The other stopper functions to prevent the associated strap from being removed from the housing.

Figure 8:
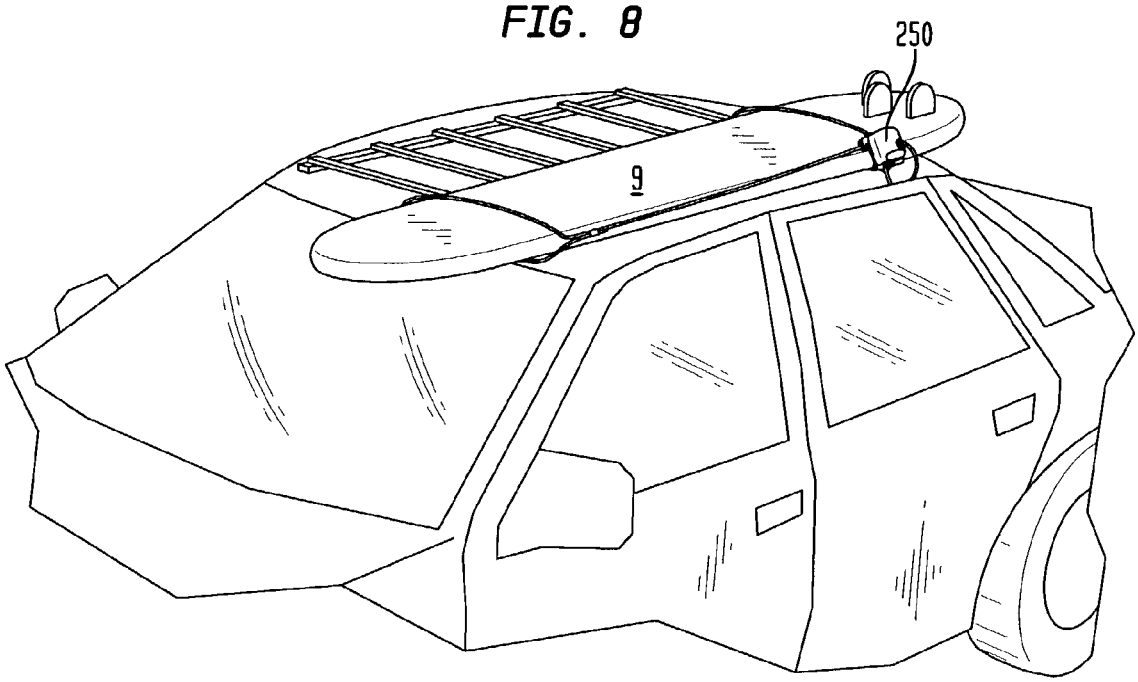
FIG. 8 is a perspective view of another embodiment of the adjustable locking strap apparatus of the present invention positioned about a surfboard on a car and locked thereto.
Figure 9A:
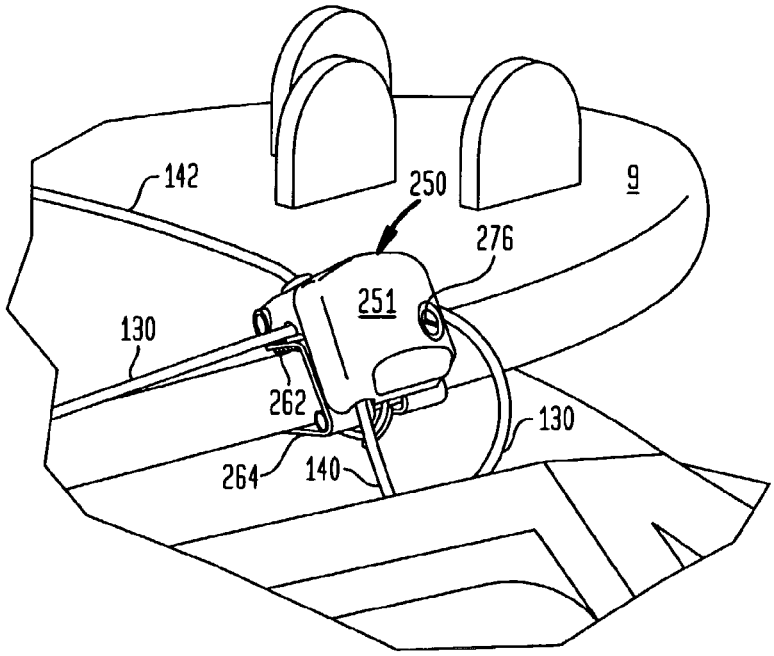
FIG. 9A is a partial perspective view of the housing of the apparatus shown in FIG. 8 in a closed position.
Figure 9B:
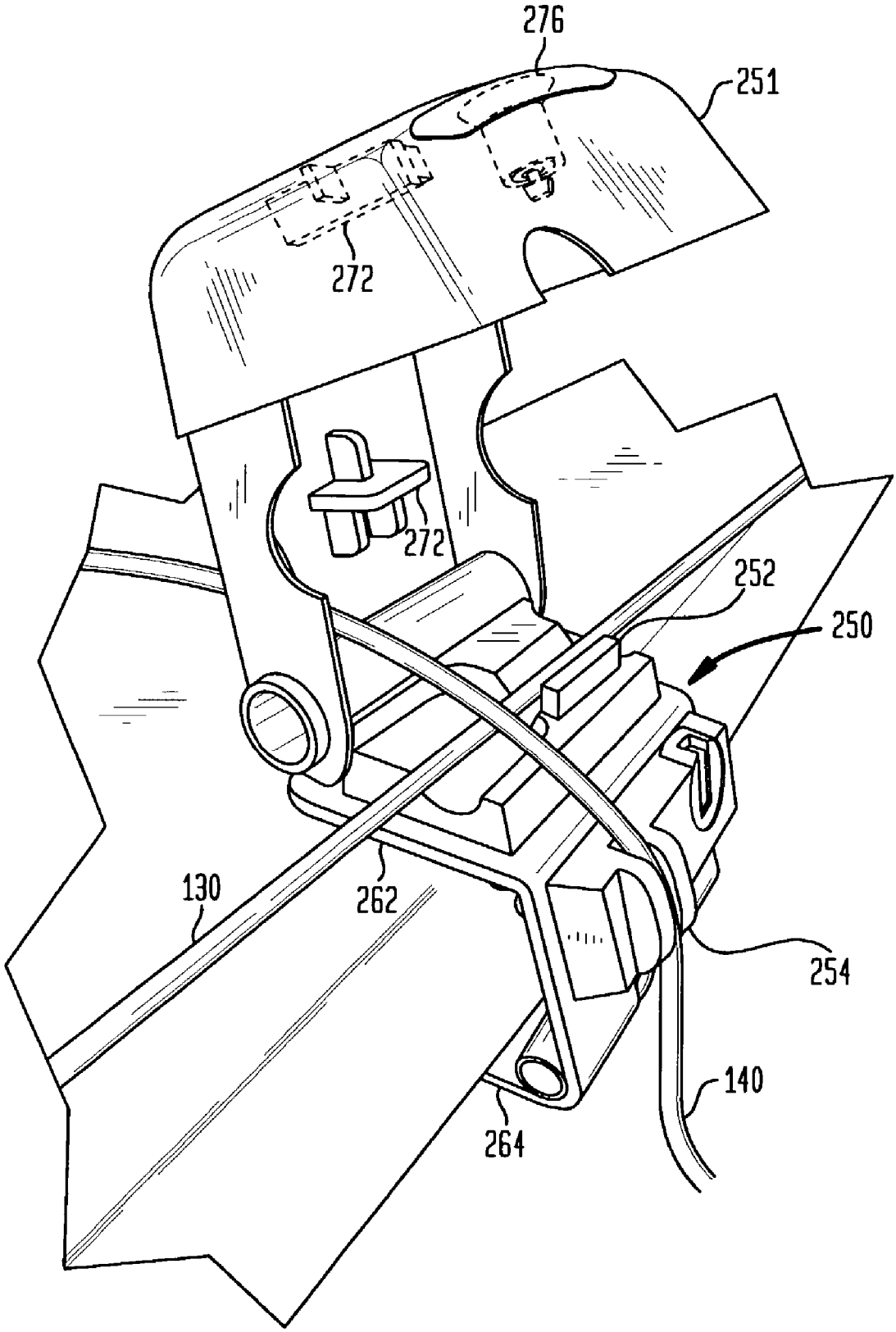
FIG. 9B is a partial perspective view of the housing of the apparatus shown in FIG. 9A in an open position.

As shown in FIGS. 8, 9A, and 9B, in another embodiment of the invention, the housing 250 can include a cover 251. The cover 251 could be attached at an edge thereof to the housing 250, and hingedly engaged therewith. Slots 252 and 254 can be formed on the housing. Fingers 272 could be positioned on an interior face of cover 251 to coact with the slots 252 and 254 to prevent the straps 130 and 140 from disengaging from the slots 252 and 254. The housing cover 251 could have a lock 276 to allow it to be locked in a closed position down on the housing 250 after the straps 130 and 140 have been engaged with the slots 252 and 254. The lock 276 could be operated by a key or in any other way known in the art. The cover could have apertures or slots to permit the straps to pass therethrough.

A rear-facing channel defined by upper leg 262 and lower leg 264 and extending from the back of housing 250 can be used to locate the housing with respect to an elongate object or a vehicle. For example, the upper and lower legs 262 and 264 can be positioned over upper and lower edges of the elongate object to locate the housing on the object. Alternatively, the upper leg 262 could be positioned under the object and the lower leg 264 could rest on a vehicle to position the housing between an object and a vehicle. It would be desirable to place a non-skid, non-scratching surface on the legs 262 and 264 to protect the elongate object and/or vehicle.

It should also be pointed out that the invention could be practiced using only one strap 140 interconnected at one end with housing 150 and looped about a surfboard between fins and a wide central portion. The strap, after looping around the surfboard, is engaged with the housing. A stopper can be engaged within a door or window of a vehicle.

Having thus described the invention in detail, it is to be understood that the foregoing description is not intended to limit the spirit and scope thereof. What is desired to be protected by Letters Patent is set forth in the appended claims.

What is claimed is:

1. An apparatus for locking an elongate object comprising:

a housing including a cover;

a first strap attached to the housing and looped about one end of the object and back to the housing;

a second strap having a loop about the other end of the object, the strap extending to the housing;

retainers on the housing including slots for frictionally retaining the straps from movement; and stoppers on the second ends of the straps.

2. The apparatus of claim 1, wherein the elongate object comprises a surfboard.

3. The apparatus of claim 1, further comprising top walls over a portion of the slots to form apertures to retain the straps in the housing.

4. The apparatus of claim 1, wherein the housing includes one or more legs extending from a rear portion for locating the housing on an elongate object.

5. The apparatus of claim 1, wherein the cover is hingedly attached to the housing.

6. The apparatus of claim 5, further comprising a lock for locking the cover with the housing in a closed position.

7. The apparatus of claim 1, wherein the cover includes fingers that coact with the slots to retain the straps in the slots.

8. The apparatus of claim 1, wherein the first and second straps comprise wires encased in plastic.

9. The apparatus of claim 8, wherein the plastic is compressible to retain the wires in the housing.

10. A method for locking an elongate object comprising:

positioning a housing having first and second slots proximate to an elongate object, the housing having a first end of a first strap attached thereto;

looping the first strap about a first end of an elongate object;

extending the first strap through a first slot in the housing;

positioning a loop of a second strap about a second end of the elongate object;

extending the second strap through a second slot in the housing;

closing a cover over the housing and locking the cover to the housing with a lock; and releasably retaining the first and second straps in the slots in the housing; and positioning stoppers disposed at second ends of the straps extending beyond the housing, through a door or window of a vehicle and closing the door or window to retain the straps.

11. The method of claim 10, further comprising tensioning the first and second straps by pulling on the first and second straps.

12. The method of claim 11, wherein the straps are inserted into slots after tensioning.

13. The method of claim 11, wherein the straps are pulled through the slots to tension the straps.

14. An apparatus for locking an elongate object comprising:

a first strap having a first loop at a first end and a first stopper at a second end, the first loop positionable about one end of an object;

a second strap having a second loop at a first end and a second stopper at a second end, the first and second stoppers positionable within a vehicle; and a housing including a pin for attachment of the second loop of the second strap, the housing including first and second slots for receiving the straps and preventing movement thereof with respect to the housing.

15. The apparatus of claim 14, wherein the housing comprises slots for frictionally retaining the straps.

16. The apparatus of claim 15, further comprising top walls over a portion of the slots to form apertures to retain the straps in the housing.

17. The apparatus of claim 15, wherein the housing includes a cover.

18. The apparatus of claim 17, wherein the cover includes fingers that coact with the slots to retain the straps in the slots.

19. The apparatus of claim 17, wherein the cover is hingedly attached to the housing.

20. The apparatus of claim 19, further comprising a lock for locking the cover with the housing in a closed position.

21. The apparatus of claim 14, wherein the first and second straps comprise wires encased in plastic.

22. The apparatus of claim 21, wherein the plastic is compressible to retain the wires in the housing.

23. The apparatus of claim 14, wherein the housing includes one or more legs extending from a rear portion for locating the housing on an elongate object.

24. An apparatus for locking an elongate object comprising:

a housing including a cover;

a first strap attached to the housing and looped about one end of the object and back to the housing, the first strap having a second end extending beyond the housing;

a second strap having a first end with a loop for extending about the other end of the object, the strap extending to the housing and having a second end extending beyond the housing;

retainers on the housing for retaining the straps from movement; and stoppers on the second ends of the straps extending beyond the housing.

25. The apparatus of claim 24, wherein the retainers of the housing comprise slots for frictionally retaining the straps.

26. The apparatus of claim 25, further comprising top walls over a portion of the slots to form apertures for retaining the straps in the housing.

27. The apparatus of claim 24, wherein the cover is hingedly attached to the housing.

28. The apparatus of claim 24, wherein the cover includes fingers that coact with the slots to retain the straps in the slots.

29. The apparatus of claim 28, further comprising a lock for locking the cover with the housing in a closed position.

30. The apparatus of claim 24, wherein the first and second straps comprise wires encased in plastic.

31. The apparatus of claim 30, wherein the plastic is compressible to retain the wires in the housing.

32. The apparatus of claim 24, wherein the elongate object comprises a surfboard.

33. The apparatus of claim 24, wherein the housing includes one or more legs extending from a rear portion for locating the housing on an elongate object.

34. An apparatus for locking an elongate object comprising:

a housing;

a first strap comprising wire encased in plastic, the first strap attached to the housing and looped about one end of the object and back to the housing;

a second strap comprising wire encased in plastic, the second strap having a loop about the other end of the object, the strap extending to the housing;

retainers on the housing including slots for frictionally retaining the straps from movement; and stoppers on the second ends of the straps.

35. The apparatus of claim 34, wherein the first and second straps extend past the housing.

36. The apparatus of claim 34, further comprising top walls over a portion of the slots to form apertures to retain the straps in the housing.

37. The apparatus of claim 34, wherein the housing includes a cover.

38. The apparatus of claim 34, wherein the plastic is compressible to retain the wires in the housing.

39. The apparatus of claim 34, wherein the elongate object comprises a surfboard.

40. The apparatus of claim 34, wherein the housing includes one or more legs extending from a rear portion for locating the housing on an elongate object.

* * * * *